United States Patent [19]

St. Clair

[11] 4,162,589

[45] Jul. 31, 1979

[54] TETHERED MODEL AIRCRAFT CONTROL SYSTEM

[76] Inventor: Oba L. St. Clair, 5035 Larkwood Ln. Eugene, Oreg. 97405

[21] Appl. No.: 790,187

[22] Filed: Apr. 25, 1977

[51] Int. Cl.[2] ..... A63H 27/04

[52] U.S. Cl. ..... 46/77; 74/469

[58] Field of Search ..... 46/77; 74/469, 501 R

[56] References Cited

U.S. PATENT DOCUMENTS

| | | | |
|---|---|---|---|
| 2,341,478 | 2/1944 | Rappl | 74/469 X |
| 2,543,965 | 3/1951 | Hamilton | 46/77 |
| 2,570,586 | 10/1951 | Nix | 46/469 X |
| 3,882,632 | 5/1975 | Quinzer | 74/501 R X |

*Primary Examiner*—F. Barry Shay

*Attorney, Agent, or Firm*—Kolisch, Hartwell, Dickinson & Stuart

[57] ABSTRACT

A three-wire control system for a tethered engine-powered model aircraft. The system features a special linkage arrangement which assures evenly distributed tension in all of the control lines under all operating circumstances. The system further features a construction which, through using a special organization of multiple pivot connections, greatly minimizes friction between moving parts, and promotes exceptionally smooth precision control of such an aircraft.

11 Claims, 9 Drawing Figures

174
176
178
180
236
182
234
170
148a
148
164
168
169
162
166
212
152
229
146
202
172
238
16
154b
196
154c
198
150
20
154
154a
18
200
194
244
142
144

240
204
206
188
246

TETHERED MODEL AIRCRAFT CONTROL SYSTEM

BACKGROUND AND SUMMARY OF THE INVENTION

This invention pertains to a control system for a tethered-type engine-powdered model aircraft, and more particularly, to such a system which accommodates the use of three control wires—two for elevator control and one for throttle control.

The flying of such aircraft is an extremely popular hobby. People involved in this hobby have a substantial interest in being able to provide smooth, full, precise, easily applied control over such an aircraft, in order to obtain maximum performance and enjoyment.

Two-wire control systems, which have been widely used in the past, typically provide simply for elevator control. With such a system, an operator has no opportunity, while an aircraft is in flight, to change the throttle setting. Such systems obviously do not afford the fullest possible control.

A number of three-wire systems have been proposed in the past, but these have, for a variety of reasons, also not been entirely satisfactory. A complaint commonly found with such prior systems is that the tension which exists in the three wires in the system, with an aircraft under flight, is not equally distributed in the wires. A result of this is that smooth precision control is difficult. For example, such unequally shared tension tends to produce unwanted control functions. Further, prior three-wire systems are characterized by interconnections between moving parts which introduce a considerable amount of friction. High friction seriously impairs smooth precision control, and in fact introduces quite jerky and erratic control.

A general object of the present invention is to provide a novel three-wire control system for a tethered-type model aircraft which enables smooth precision control of a flying aircraft, and which specifically and significantly avoids the disadvantages and drawbacks of prior art systems.

More specifically, an object of the invention is to provide such a system wherein, under substantially all operating conditions with an aircraft flying, tension in the tethering lines is substantially equally distributed.

A further object of the invention is to provide a system of the type generally outlined wherein low-friction pivot connections are provided between the moving parts, which connections greatly minimize friction, and enhance the smoothness and precision capabilities of flight control.

Yet another important object of the present invention is to provide a control system as outlined wherein control of a line or wire for changing throttle speed has no effect on the disposition of elevators, and vice versa.

Another point which should also be mentioned preliminarily, is that existing tethered aircraft control systems are often extremely difficult for a beginner to manipulate successfully. Until such a person gains a "feel" for the handling of such a craft, he can easily overcontrol or overcompensate in his efforts, and in the past this has often resulted in an aircraft crashing. Still a further object of the present invention, therefore, is to provide a control system as so far outlined which also is especially suited to handling by a beginner.

Featured by the invention is a special multiple-link linkage arrangement, wherein links are interconnected for relative pivotal movement through low-friction pivot connections. Links in this arrangement provide locations for the attachment of the ends of the three control lines contemplated for use in the system. In the system described herein, slightly different modifications of such a linkage arrangement are provided for use both in a hand-held control device, and within the structure of a model aircraft using the system.

As an aid to a beginner in manipulating a device constructed in accordance with the invention, the above-mentioned low-friction pivot connections, through inhibiting jerky control, tend to prevent overcompensation. Further, a unique locking means is provided, as will be described, which enables the throttle control mechanism in the apparatus to be locked in an infinite number of different positions so that, once a satisfactory throttle position (for the beginner) has been attained, this can be maintained without requiring his attention.

As will become apparent from the description which now follows, the novel linkage arrangement proposed by the invention may be incorporated into a variety of hand control devices which offer various means for introducing elevator and/or throttle control. By way of description herein, several such devices are discussed.

Various other features and advantages offered by the invention will become apparent as the below description thereof is read in conjunction with the accompanying drawings.

DETAILED DESCRIPTION OF THE INVENTION

Figures 1, 2, 3:
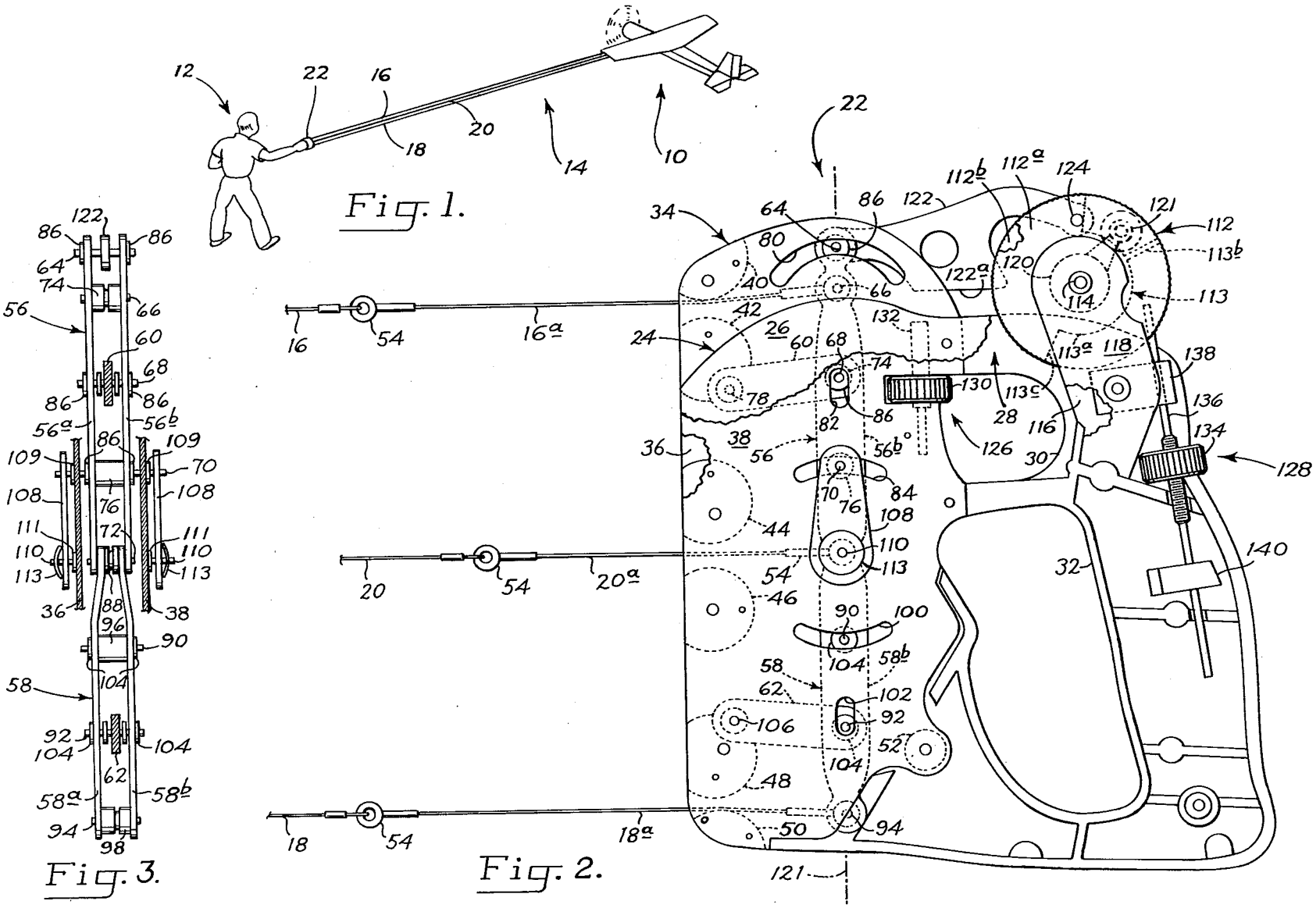
FIG. 1 is a simplified sketch showing a person operating a flying model aircraft using a control system constructed in accordance with the present invention.
FIG. 2 is a side elevation, with a cover plate removed (to show construction details) illustrating an embodiment of a hand-held control device used in the system of FIG. 1.
FIG. 3 is a fragmentary front elevation, taken generally from the left side of FIG. 2, illustrating details of interconnections which exist between various links used in the device of FIG. 2.

Turning now to the drawings, and referring first to FIG. 1, indicated generally at 10 is a flying engine-powered model aircraft of the tethered variety which is under the control of an operator shown at 12. Operator 12 exercises control over the aircraft through a control system, indicated generally at 14, employing three tethering lines 16, 18, 20 which extend between the aircraft and a hand-held control device 22 held by the operator.

As will become more fully apparent, lines 16, 18 are used for controlling the angular position of the usual elevator provided in aircraft 10, and line 20 is used for adjusting the position of the usual engine throttle provided in the aircraft.

Constructional features of the invention are found contained both within the structure of aircraft 10, and within control device 22. Beginning with the construction of the control device, this is shown in FIGS. 2 and 3, to which attention is now directed. Reference may also be had at this point to FIGS. 7 and 8 which show different parts inside the control device in different moved positions.

Device 22 includes a two-piece handle 24 including opposed side pieces 26, 28 which are held together by any suitable means, such as by nut and bolt assemblies. These handle pieces may conveniently be formed of any suitable lightweight material, such as a molded plastic material, with the side pieces including upper and lower openings, such as those shown at 30, 32, respectively, in side piece 28 in FIG. 2. These openings accommodate ready gripping of the device, with the openings, like-opening 30, adapted for receiving a user's forefinger, and the openings, like opening 32, accommodating remaining fingers other than the thumb. The outsides of the handle pieces are suitably contoured for comfortable holding of the device.

Suitably clamped between the handle side pieces, toward the left (or front) sides thereof in FIG. 2, is a linkage arrangement 34, which is also referred to herein as a second control-adjustment mechanism, constructed in accordance with the present invention. Included within mechanism 34 is a frame comprising a pair of spaced planar parallel plates 36, 38 which are held together in any suitable fashion, and retained in their spaced-apart condition by means of multiple distributed spacers, such as those shown at 40, 42, 44, 46, 48, 50, 52. The peripheral outlines of plates 36, 38 are substantially identical, and are as illustrated in FIG. 2. It should be noted that the specific outline which is shown forms no part of the present invention, but rather has been found to be a convenient outline for use in conjunction with a handle shaped like handle 24. Preferably, plates 36, 38 are made of a suitable lightweight material, such as aluminum. Spacers 40 and 42, 44 and 46, 48 and 50 act as respective cooperative pairs of guides in the control device for guiding short lines, such as those shown at 16*a*, 18*a*, 20*a*, that are connected to previously mentioned tethering lines 16, 18, 20, respectively. To this end, these guide-functioning spacers are formed on a suitable wear material, such as nylon. Spacer 52 may be formed of any suitable material that need not be a wear material.

As can be seen, line 16*a* extends between spacers 40, 42, line 18*a* between spacers 48, 50, and line 20*a* between spacers 44, 46. The opposite ends of these lines are provided with eye attachments, such as attachments 54—those adjacent the left ends of lines 16*a*, 18*a*, 20*a* being connected to suitable hooks which are joined to the ends of lines 16, 18, 20, respectively. The manners in which the right ends of lines 16*a*, 18*a*, 20*a* in FIG. 2 are attached will be explained shortly.

It might be pointed out that while spacers 40–50, inclusive, have been shown herein to be individual units, they could easily be replaced, if desired, with a single spacer unit appropriately shaped and apertured.

Included in linkage arrangement 34, between plates 36, 38, are a pair of floating links 56, 58, and a pair of stabilizer links 60, 62 which are associated with links 56, 58, respectively. Links 60, 62 constitute second stabilizer links herein. It will be recalled that FIG. 3 shows a front elevation of the inner workings of linkage arrangement 34, and this figure should now be referred to in considering the construction of such inner workings.

Link 56 is formed from a pair of spaced substantially parallel link plates 56*a*, 56*b* which have the side outlines shown in dashed lines in FIG. 2. These two plates are interconnected through rigidly secured pins shown at 64, 66, 68, 70, 72 (see FIG. 3), and spacers 74, 76. Spacer 74 is circumferentially grooved (as can be seen in FIG. 3), with the groove in the spacer accommodating a connection with the eye attachment provided adjacent the right end of line 16*a* in FIG. 2. The link plates and spacers in link 56 are formed of the same material as plates 36, 38. The pins described are formed from a high-carbon steel, for a reason which will be explained shortly.

The right end of stabilizer link 60 in FIG. 2 is journaled on pin 68, and the left end of this link is pivoted on and between frame plates 36, 38 through a pin 78 which is anchored to the frame plates. Pin 78, like those previously mentioned, is formed of a high-carbon steel.

Where link 60 is journaled on pin 68, the link is provided with a suitable bearing-clearance bore which rotatably receives the pin. The same is true where the link is pivoted on pin 78. Such a bearing arrangement, with aluminum working against high-carbon steel, offers extremely low-friction performance, which is one of the key features of the present invention. If desired, an even lower-friction pivot or journal connection is possible, by fitting the bores in the link with bronze sleeves which then turn on the pins. Experience has shown that, in most instances, it is entirely adequate to construct the various pivot and journal connections in a hand control link control device 22 with aluminum working directly against high-carbon steel. And, as will further be explained later herein, it has been found to be preferable, in a linkage arrangement (still to be described) used in the fuselage of a model aircraft, to employ the alternate construction described where bronze sleeves are employed to ride against high-carbon steel pins. The reason for such preference is that, whereas only a slight difference in the performance of a hand control device will be noticed through employing the lower-friction characteristics of bronze on steel, this somewhat superior friction characteristic may more easily be noticed in the performance of a flying aircraft.

As can be seen particularly in FIG. 3, and for a reason which will shortly be explained, pins 64, 68, 70 protrude axially from opposite sides of link 56 a considerable distance. Accordingly, and in order to provide zero-friction frame-clearance for these pins, suitable accommodating slots are provided in frame plates 36, 38. Thus, arcuate slots, such as slot 80, are provided in plates 36, 38 for pin 64; arcuate slots, such as slot 82, are provided to accommodate pin 68; and arcuate slots, such as slot 84, are provided to accommodate pin 70. To avoid contact between link 56 and plates 36, 38, steel washers, such as those shown at 86, are mounted on pins 64, 68, 70 on the outside of plates 56*a*, 56*b*. Projection of pins 64, 68, 70 into slots 80, 82, 84, respectively, retains the washers on the pins, and allows the use of such washers.

Floating link 58 is formed from a pair of spaced-apart substantially parallel link plates 58*a*, 58*b* which have the side outlines shown in dashed lines in FIG. 2. The upper ends of these two plates (as can be seen in FIG. 3) are bent inwardly toward each other, and are received within the lower ends of link plates 56a, 56b. Plates 58a, 58b are formed of the same material as plates 56a, 56b.

The two floating links are pivotally interconnected by means of previously mentioned pin 72. Mounted on pin 72, between the ends of plates 58a, 58b is a spacer 88 which is circumferentially grooved like previously mentioned spacer 74. The groove in spacer 88 accommodates mounting of the eye attachment provided on the right end of line 20a in FIG. 2.

Further describing floating link 58, the link plates therein are interconnected through pins 90, 92, 94 and spacers 96, 98. Spacer 98, like spacers 74, 88, is circumferentially grooved, with this groove accommodating mounting of the eye attachment provided on the right end of line 18a in FIG. 2. Pins 90, 92, 94, like the previously mentioned pins, are formed of a high-carbon steel.

As can be seen in FIG. 3, pins 90, 92 protrude axially from opposite sides of link 58, and to accommodate movement of these pins without allowing the pins to contact frame plates 36, 38, slots are provided in the frame plates. Thus, a pair of arcuate slots, like slot 100, is provided for accommodating movement of pin 90, and a pair of arcuate slots, like slot 102, is provided for accommodating movement of pin 92. Steel spacer washers 104, like washers 86, are mounted on pins 90, 92 against the outside faces of plates 58a, 58b.

The right end of stabilizer link 62 in FIG. 2 is journaled on pin 92, and the left end of this link in the figure is pivoted on and between frame plates 36, 38 by a pin 106. Pin 106, like the previously mentioned pins, is formed of a high-carbon steel.

Completing a description of the parts which make up linkage arrangement 34, the arrangement includes yet another stabilizer link, also referred to as a first stabilizer link, and formed from a pair of link plates 108, which are disposed on the outsides of frame plates 36, 38 (see FIG. 3). The lower ends of these link plates in FIGS. 2 and 3 are pivoted on plates 36, 38 through a pair of coaxial pivot pins 110. The upper ends of the plates are journaled on pin 70. Steel washers 109 on pin 70 separate plates 108 from plates 36, 38. Similar washers 111 on pins 110 separate these same plates. Bent spring washers 113 are mounted on the outer ends of pins 110. These washers apply play-reducing lateral pressure on plates 108 with handle pieces 26, 28 fastened together.

The various parts in linkage arrangement 34 as depicted in FIG. 2 are shown occupying the positions which they have when, as will be more fully explained, the control device has been operated to place an aircraft throttle in substantially the halfthrottle condition. The parts are therefore depicted in what might be referred to as central positions. In these positions, pivot pins 110 are axially aligned with pin 72, and these pins, along with pins 64, 66, 68, 70, 90, 92, 94 occupy a common plane, shown at 121 in FIG. 2.

Considering some important dimensions, the distances between the axes of pins 66 and 68, 68 and 70, 70 and 72, 72 and 90, 90 and 92, 92 and 94, and 70 and 110 are all substantially equal. The distances between the axes of pins 68 and 78, and between those of 92 and 106, are substantially equal, and are each preferably no less than about 62.5% of the distance between the axes of pins 68, 72 (which is the same as the distance between the axes of pins 72, 92). The reasons for the importance of these several particular dimensions will be explained shortly.

It will become apparent, or perhaps already is apparent to those familiar with the flying of tethered model aircraft, that elevator control is effected through tilting of control device 22 in the plane of FIG. 2, upwardly and downwardly, so as to adjust the relative positions of lines 16, 18. Control of engine speed requires control of the position of line 20 relative to lines 16, 18, and such control takes place by operation of linkage arrangement 34 through yet another mechanism, now to be described, contained within the control device.

Indicated at 112 in FIG. 2 is a throttle-control wheel formed from a pair of axially aligned discs 112a, 112b which include abutting, axially inwardly projecting hub portions 113. Hub portions 113 are cut away as indicated to form a clearance space between the discs defined by a central curved surface 113a which joins with end shoulders 113b, 113c. Wheel 112 is journaled on a pin 114 which is carried on a subframe formed from a pair of plates 116, 118 which are suitably clamped in place between handle side pieces 26, 28. Wheel 112 is provided with a locking mechanism 120 which is actuated by a finger-operable lever 121 accessible in an opening provided at the periphery of the wheel. Lever 121 may be adjusted in one angular direction to free the wheel for free rotation, and in the opposite direction to lock the wheel in place so as to fix a particular throttle setting called for by the position of wheel 112. The advantage of providing for such a locking feature will be mentioned later.

Details of the locking mechanism, which form no part of the present invention, are omitted from discussion herein. It is recognized, of course, that a variety of different kinds of constructions, known to those skilled in the art, may be used for such a mechanism.

Indicated at 122 is a drive link. Link 122 has the peripheral outline shown for it in FIG. 2, with the bottom side of this link in FIG. 2 being provided with an edge 122a whose particular function will be explained shortly. The left end of link 122 in FIG. 2 is journaled on pin 64, and the right end of the link in the figure is pivoted at 124 to wheel 112.

Also provided in control device 22 are two adjustable limit mechanisms, which, after attaching of lines 16, 18, 20, are adjusted to define movement limits within linkage arrangement 34 in such a manner that, throughout operation of the linkage arrangement, the tethering lines remain evenly tensed, without slack developing in any line. These two mechanisms are shown generally at 126, 128. Mechanism 126 includes a wheel 130 which is rotatable on a generally upright axis, and which is suitably journaled on handle side pieces 26, 28, and a threaded pin 132 which is threadedly received in a central bore provided in wheel 130. With turning of wheel 130, the vertical position of pin 132 changes, and the upper end of this pin in FIG. 2 is intended to be engaged by edge 122a in drive link 122 to limit forward motion of the link (resulting from counterclockwise rotation of wheel 112 in FIG. 2).

Mechanism 128 includes a similar wheel 134, also suitably journaled for rotation on the handle side pieces. Wheel 134 works in conjunction with an elongated centrally threaded pin 136, opposite ends of which are slidably received in guides 138, 140 that are clamped between the handle side pieces. The upper end of pin 136 extends into the special space (mentioned earlier) between discs 112a 112b and is adapted to be engaged by shoulder 113b with clockwise rotation of wheel 112 in FIG. 2 to shift link 122 rearwardly.

Figure 9:
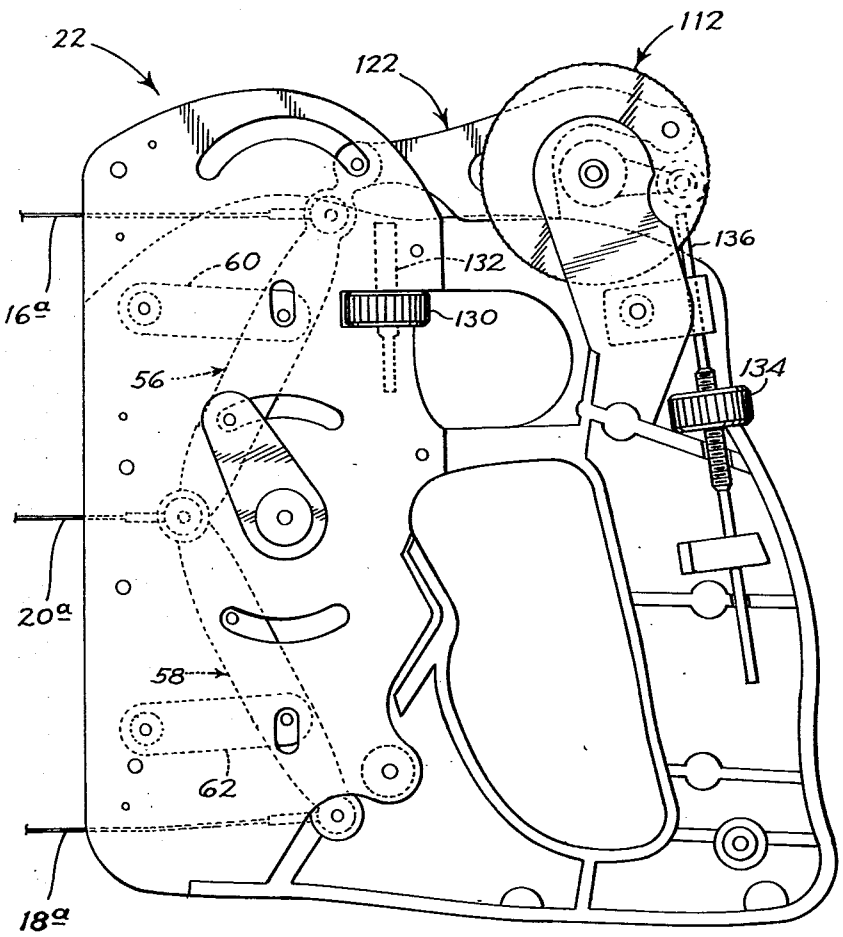
FIGS. 8 and 9 show the same control device illustrated in FIG. 2, and along with FIG. 2, show parts of this device in the different respective relative positions which they occupy to place the linkage arrangement of FIGS. 4, 5 and 6 in the different positions shown for it, respectively, in these three figures.
Figure 8:
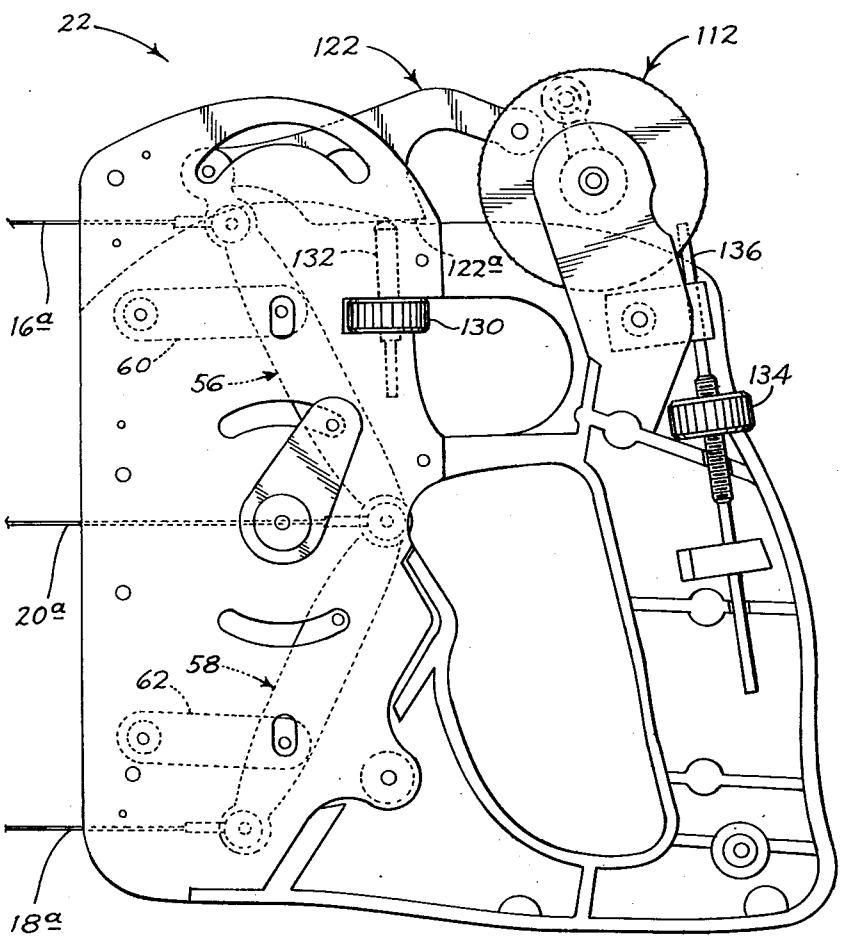

Referring for a moment to FIGS. 8 and 9 along with FIG. 2, FIGS. 8 and 9 show device 22 adjusted to two different "limit" control conditions. More specifically, FIG. 8 shows wheel 112 rotated counterclockwise to a limit position, with the result that line 20a is drawn in and lines 16a, 18a are extended. Under this control circumstance, what might be though of as minimum throttle is called for in the aircraft engine, and no change has occurred in the position of the aircraft elevator. FIG. 9 shows an opposite limit control condition with control line 20a extended and lines 16a, 18a drawn in. This condition calls for a maximum throttle condition in the aircraft engine, and again, no change has been made in the attitude of the aircraft elevator. The setting of the specific limit conditions thus illustrated in FIGS. 8 and 9 will be explained shortly.

Referring now to FIGS. 4–7, inclusive, indicated therein generally at 142 is another linkage arrangement constructed in accordance with the present invention, and also referred to as a first control-adjustment mechanism herein. Linkage arrangement 142 is disposed within the fuselage of aircraft 10, such fuselage being shown fragmentarily at 144 in FIGS. 4, 5 and 6.

Linkage arrangement 142 includes a frame, also referred to as a first frame herein, 146, and mounted on this frame a plurality of links including links 148, 150, 152 and 154. These various links have the circumferential outlines shown for them in the figures. Frame 146 and links 148, 150, 152, 154 are preferably formed from a suitable lightweight material such as sheet aluminum.

Link 148 includes an irregularly shaped curvilinear central opening 148a which acts herein, as will be explained, as a special control cam. Working in cooperation with link 148 is a curvilinear plate 156 which is smaller than link 148 and which has a circumferential outline that matches a portion of that of link 148. Plate 156 is generally a U-shaped part, with the central portion of the U having an outline matching a portion of opening 148a. Plate 156 is spaced below link 148 through spacers 158, and is secured to the link through rivets 160. This assembly of link 148 and plate 156 straddles the right end of frame 146 in the figures, and is pivoted to the frame through a high-carbon steel pivot pin 162. Bronze bushings (concealed in the figures) are fitted into link 148 and plate 156 and rotatably receive pin 162. Encircling pin 162 is a biasing spring 164, the left end of which in the figures acts against a post 166 suitably anchored on top of frame 146. The right end of spring 164 in the figures nominally rests against a post 168 joined to frame 146. The spring is engageable with a post 169, fastened to the top of link 148, which counterclockwise pivoting of the link.

Figures 4, 5, 6:
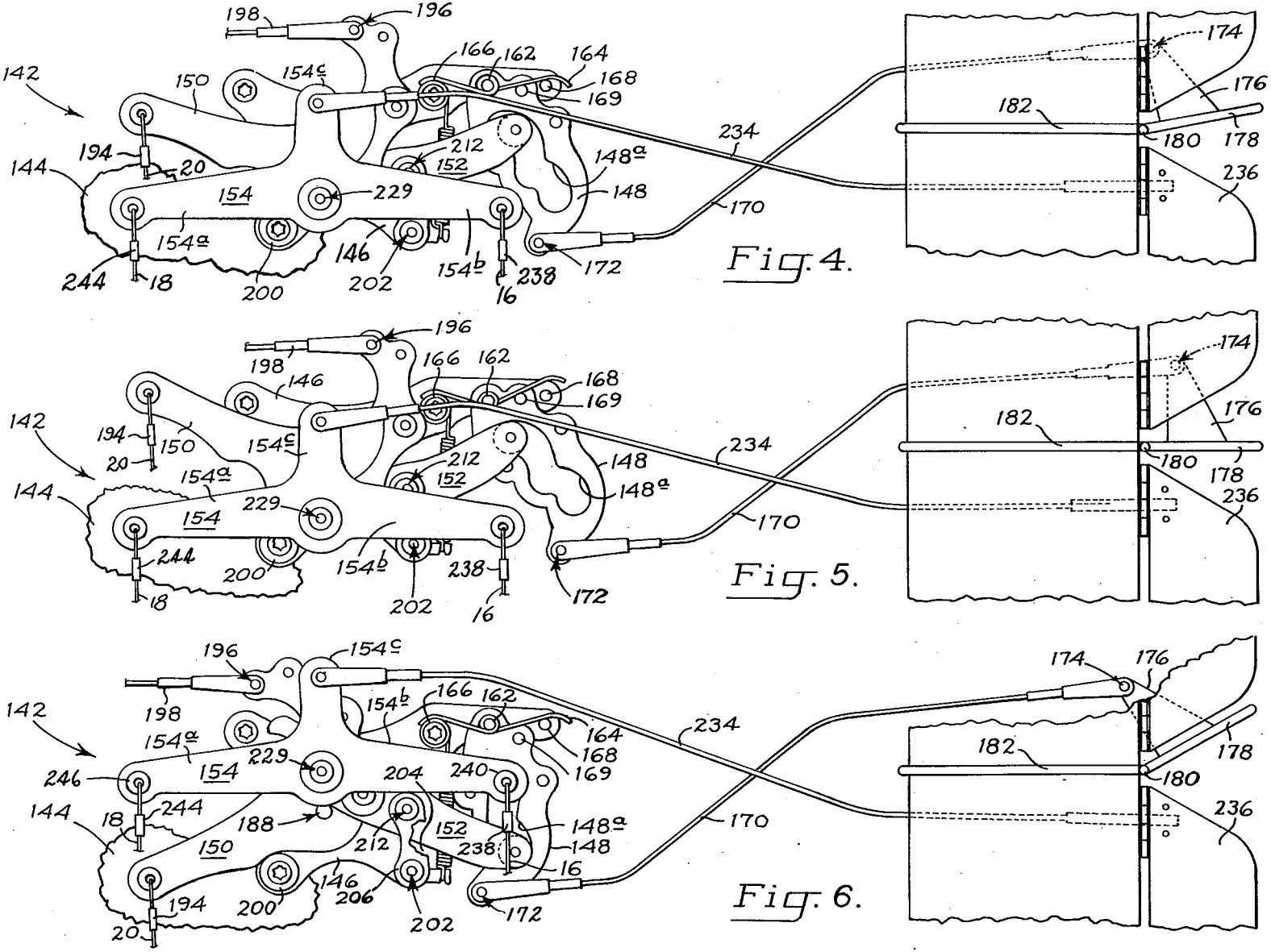
FIGS. 4, 5 and 6 are top plan views, each illustrating the details of construction of a linkage arrangement forming part of the invention and used within the structure of the aircraft shown in FIG. 1, with these three figures depicting such arrangement in three different control conditions.

Shown at 170 in FIGS. 4–7, inclusive, is an angular connecting rod which is used herein to adjust the rudder in aircraft 10. The left end of rod 170 in the figures is pinned to link 148 through a pivot connection 172. Pivot connection 172 includes a steel pivot pin which extends through a bronze collar that is mounted on link 148. The right end of rod 170, as seen in FIGS. 4–6, inclusive, is pivoted at 174 to a lug 176 which extends to one side of rubber 178. Rubber 178 is hinged at 180 to the rudder fin 182 in aircraft 10.

Link 150 is provided with a central bore 184 which accommodates a pivot connection with a bore 186 provided in frame 146. The pivot connection between link 150 and frame 146 accommodated by these two bores, which pivot connection is designated generally at 188 in FIG. 6, includes a high-carbon steel pivot pin received within bronze bearing collars that are mounted within bores 184, 186. Pivot connection 188 is thus, like the others so far mentioned in arrangement 142, also an extremely low-friction connection.

Provided at the left end of link 150 in the figures is an aperture 190 in which is fitted a bronze collar 192. The outer extremity of previously mentioned tethering line 20 is attached through a hook 194 with the opening in collar 192. This situation is illustrated in FIGS. 4, 5 and 6. Pivoted at 196 to link 150 is one end of an elongated throttle-actuating rod shown fragmentarily at 198. Pivot connection 196 is also of the bronze collar—high-carbon steel pin construction. Shifting of this rod to the right in FIGS. 4, 5 and 6 opens the throttle in the aircraft engine, and shifting to the left closes the throttle. Mounted adjacent the left side of frame 146 in the figures is a post 200 which acts as a stop for counterclockwise pivoting of link 150 on the frame.

Figure 7:
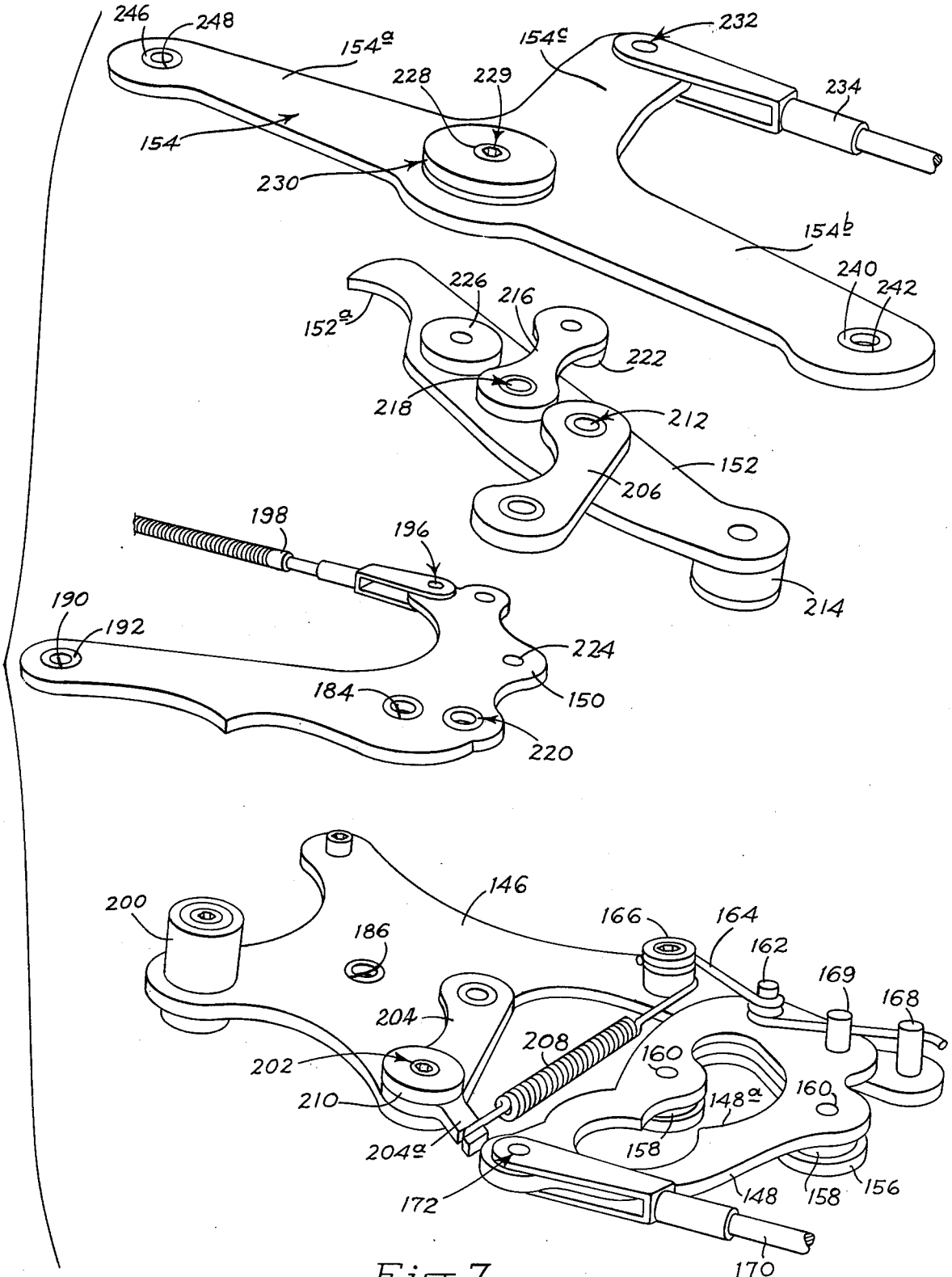
FIG. 7 is an enlarged, exploded, perspective view of parts in the linkage arrangement of FIGS. 4, 5 and 6.

Pivoted at 202 on frame 146 are two links 204, 206, which work together herein as will be explained. In FIG. 7, link 204 is shown closely adjacent the frame, with link 206 being illustrated in an exploded, moved position above the frame. With respect to link 206, it is the near end thereof in FIG. 7 which is attached through pivot connection 202. Link 204 includes a projection 204a which is connected through a biasing spring 208 with previously mentioned post 166. Link 204 lies substantially in the same plane in mechanism 142 as link 148, with link 206 spaced upwardly in FIG. 7 from link 204 through a spacing washer 210. Low-friction bearings, like those previously described including a steel pin received within bronze collars, characterizes the construction of pivot connection 202.

Considering now the mounting provided for link 152, this link is straddled by links 204, 206 which are pivoted thereto through a low-friction bronze-steel pivot connection 212. In FIG. 7, link 206 is shown directly adjacent link 152, and link 204 is spaced therebeneath. It is the far end in FIG. 7 of link 204 which is pivoted at 212. Mounted on the right end of link 152 in FIG. 7 is a cylindrical projection 214 which extends into opening 148a in link 148. This projection acts as a cam follower with respect to such opening. Shown at 216 is a link which is pivoted at 218 to link 152. Pivot connection 218 also attaches to link 150 beneath link 152, and more particularly includes the opening shown in bronze collar 220 mounted in a bore in link 150. Mounted on the other end of link 216 in FIG. 7 is a downwardly projecting spacing washer 222 which contacts the upper surface of link 150. This other end of link 216 is secured through washer 222 to link 150 at the location of bore 224 in link 150. Mounted on top of link 152 in FIG. 7 is a spacing washer 226, the function of which will be explained shortly. Finally, the left end of link 152 in FIG. 7 is provided with a curved cutaway 152a which is engageable with previously mentioned post 200 to limit counterclockwise pivoting of link 150 relative to frame 146 (as will be explained).

Completing a description of linkage arrangement 142, link 154 is somewhat T-shaped, including a pair of arms 154a, 154b and a central stem 154c. Link 154 rests on washer 226, and is pivoted thereto at 229 through a steel pivot pin (removed) which interconnects the central aperture in washer 226 with the aperture in bronze collar 228 which is mounted in an assembly 230 on link 154. Pivoted at 232 adjacent the outer end of stem 154c is one end of an elongated elevator control rod shown at 234. Referring specifically to FIGS. 4, 5 and 6, the right end of rod 234 therein extends toward the tail section of airplane 10, and is suitably attached to the elevator 236 in the airplane.

The outer end of tether line 16 connects through a hook 238 with the central aperture in a bronze collar 240 mounted in a bore 242 adjacent the right end of link arm 154*b* in the figures. The outer end of tethering line 18 connects through a hook 244 with the central aperture in a bronze collar 246 mounted within a bore 248 provided adjacent the left end of link arm 154*a* in the figures.

In linkage arrangement 142, link 152 constitutes a "floating link" herein, that portion (see especially FIG. 7) of link 150 which exists and extends between the pivot connection through bore 184 and that through collar 220 constitutes a "first stabilizer link", and the combination of links 204, 206 constitutes a "second stabilizer link".

Considering an important dimensional aspect of assembly 142, it is preferable that the distance between the axes of pivot connections 202, 212 be no less than about 62.5% of the distance between the axes of pivot connections 212, 229.

Explaining now how the apparatus of the invention performs, let us begin by explaining an initial procedure of setting up hand-control device 22, along with tethering lines 16, 18, 20, to control aircraft 10. It will be assumed that lines 16, 18, 20 have initially been prepared to have substantially equal lengths. These lines are connected between the hand-control device and linkage arrangement 142 in the manner generally illustrated in FIGS. 1, 2 and 4–6, inclusive. Wheels 130, 134 are initially adjusted to allow for maximum rotation of wheel 112. The aircraft is then anchored in place, and the hand-control device moved to a spaced location so as to stretch out the tethering lines as fully as possible. Wheel 112 is then rotated in the counterclockwise direction in FIG. 2 to the maximum extent, and under this circumstance, and considering that the tethering lines are of substantially equal lengths, this will produce tension in throttle control line 20 and slack in elevator control lines 16, 18. Under this circumstance, wheel 130 is adjusted so as slowly to produce clockwise rotation of wheel 112 in FIG. 2 to a condition where all three of the tethering lines have substantially the same tension.

Next, wheel 112 is rotated fully clockwise in FIG. 2, whereupon elevator lines 16, 18 will be tensed, and throttle line 20 slacked. Wheel 134 is then adjusted to rotate wheel 112 slightly in a counterclockwise direction to a position where, again, all three tethering lines have substantially equal tension. A circumstance now exists wherein, with the tethering lines stretched between the aircraft and the hand-control device, tension in the three tethering lines remains substantially constant and uniformly distributed throughout the full range of rotary motion permitted control wheel 112.

The handle of control device 22, during flight of the aircraft, is held in a conventional "pistol-grip" fashion. The parts in the hand-control device, and in linkage arrangement 142, are shown in FIGS. 2 and 4 generally in the conditions which they occupy with wheel 112 in a centralized position between its opposite limits of rotation. This circumstance produces what might be thought of as a half-throttle condition in the engine in the aircraft. Further, with the control lines extending from the hand-control device as illustrated in FIG. 2, the elevator in the aircraft is in what might be thought of as a level or neutral condition—producing substantially level flight of the aircraft.

When it is desired to cause the aircraft to climb, the hand-control device is rocked slightly clockwise in FIG. 2 to pull in on line 16 relative to line 18. This causes upward pivoting of elevator 236, with resultant climbing of the aircraft. The aircraft may be leveled out at a new altitude by rerotating the hand-control device to its original "neutral-elevator" orientation. To reduce the aircraft's altitude, the hand-control device is rotated slightly counterclockwise in FIG. 2 to extend line 16 relative to line 18. This causes downward pivoting of elevator 236, with resultant lowering of the aircraft. Again, releveling of the aircraft is accomplished by returning the hand-control device to its original attitude.

All during these adjustments, and because equal tension is maintained in the tethering lines, and because of the fact that the three tethering lines, where they emerge from the front face of the hand-control device emerge along a common plane, results in no change occurring in the relative position of throttle control line 20. As a consequence, raising and lowering of the aircraft takes place without any change in throttle condition. While this situation has been described in connection with the throttle tethering line being adjusted to a half-throttle condition, because of the fact that equal tension is maintained in the lines throughout total movement of wheel 112, the same thing will occur regardless of the exact setting of the position of the throttle line.

Explaining now throttle adjustment with the apparatus of the invention, this, of course, takes place through rotation of wheel 112. To open the aircraft's throttle, wheel 112 is rotated clockwise in FIG. 2. This results in taking in of tethering lines 16, 18, and paying out of line 20. Taking in of lines 16, 18 pulls on link 154, and as a consequence, and through the interaction of the various other links and pivot connections in linkage arrangement 142, this causes clockwise pivoting of link 150. The sizes of the parts in linkage arrangement 34 and in linkage arrangement 142 are such that with this kind of adjustment of the relative positions of the three tethering lines, no tension change occurs in any of the lines. In other words, the distances moved by the inner ends of lines 16, 18, 20 as a result of operation of the hand-control device are exactly the same as the distances moved by the outer ends of the lines with adjustment in linkage arrangement 142. This is an important feature in maintaining sure control over the flight of the aircraft.

As a consequence of clockwise pivoting (in FIGS. 4, 5 and 6) of link 150, throttle control rod 198 shifts to the right in these figures to open the throttle. Whereas FIG. 4 shows a condition in linkage arrangement 142 representative of the half-throttle condition, FIG. 5 illustrates the relative positions of the parts under what might be thought of as a full-throttle condition.

Closing the throttle results from a reverse rotation of wheel 112, in a counterclockwise direction in FIG. 2. This results in paying out of tethering lines 16, 18, and taking up of line 20. Taking up of line 20 pulls on the left end of link 150 in FIGS. 4–7, inclusive, and such pulling results in upward shifting of link 154 in FIGS. 4, 5 and 6. Again, movement of the inner ends of the tethering lines is matched by movement of the outer ends, and as a consequence, there is no tension change in any of the lines. Such pulling on link 150, of course, causes shifting of throttle control rod 198 to the left in FIGS. 4, 5 and 6 to close the throttle of the aircraft engine.

Throughout movement of wheel 112 to open and close the aircraft throttle, friction between the moving parts in the two linkage arrangements is held at an absolute minimum, and as a consequence, extremely smooth control is afforded. Further, in the absence of any change of the angular position of the hand-control device during such throttle adjustment, there is no change in the angular position of link 154 and hence, no alteration of the attitude of the aircraft elevator.

Spring 208 functions to create a toggle-type action in linkage arrangement 142 with respect to control of an aircraft engine throttle. More specifically, and with respect to an overcenter position related to a half-throttle condition, the spring tends to urge throttle control either toward maximum or minimum throttle. This action has been found to improve throttle control.

An extremely important feature of the apparatus of the invention is that throttle adjustment and elevator adjustment are substantially completely independent. More specifically, and quite apart from the question of any problems that could be caused by friction, the proposed linkage arrangement operates in such a way, as has been explained, that tension in the three tethering lines remains unchanged during both throttle and elevator adjustment. In other words, the proposed arrangement of links assures the independent operation described. The specific ways in which the various links are sized, oriented and pivoted relative to one another assures this uniform distribution and maintenance of tension at all times in the three lines. Enhancing this independence capability are the extremely low-friction pivot connections, and the absence of any frictional sliding connections, proposed in the apparatus. Consequently, and particularly during throttle adjustment, there is no tendency of the links in the linkage arrangements to stick as they move relative to one another. Such sticking would, of course, interfere with independent throttle and elevator control.

As a result of all of these factors and considerations it is an extremely simple matter smoothly to control the flight of an aircraft, such as aircraft 10.

Considering yet another operational aspect of the proposed apparatus, and referring particularly to FIGS. 4–6, inclusive, it will be noted that adjustment of the throttle condition results in adjustment of the angular position of the aircraft's rudder. This occurs through the interaction of cam follower 214 and cam **148*a*. The special shape provided for cam 148*a* causes rudder adjustment in a direction increasing rudder angle with closing of an engine throttle, and decreasing rudder angle with opening of the throttle. This situation is clearly illustrated in the mentioned figures. For example, in FIG. 4 rudder 178 is shown at a slight angle with respect to rudder fin 182. In FIG. 5, which illustrates a maximum throttle condition, the rudder lies substantially in the same plane as the rudder fin. In FIG. 6, which illustrates a minimum throttle condition, rudder 178 lies at a substantially greater angle relative to rudder fin 182**.

Those skilled in the art know that it is desirable, and usually necessary, to have some slight rudder angularity, like that depicted in FIG. 4, during normal flight conditions. This is to cause the aircraft to tend to fly outwardly away from the operator, so as to maintain reasonable tension in the tethering lines, thereby to improve control. The apparatus proposed by the present invention enhances this operational consideration by providing for automatic rudder adjustment to account for changes in aircraft speed. Thus, when an aircraft is flying relatively slowly, as for example with the throttle substantially fully closed (see FIG. 6), a greater rudder angle is produced which tends still to maintain a sufficient control tension in the tethering lines. In the absence of such rudder adjustment, tension in the tethering lines would drop off significantly were the rudder angle simply maintained at that illustrated in FIG. 4 as the aircraft slows down. Under circumstances with the aircraft flying at maximum speed (see the throttle adjustment depicted in FIG. 5), straightening of the rudder, or perhaps more accurately aligning of the rudder with the plane of the rudder fin, tends to reduce the tension in the tethering line below that which would exist with a fixed rudder positioned like that shown in FIG. 4. This also is an aid in enhancing control, inasmuch as a too great tension resulting in the tethering lines increases the chance of jerky operation in any linkage mechanism used for adjusting the positions of the tethering lines. Spring 164 previously described acts under circumstances of a throttle adjustment like that shown in FIG. 5 to assure return pivoting of link 148 (with slight closing of the throttle) to return the rudder to the angular position shown for it in FIG. 4.

As a final observation about this feature, it is preferred, and cam **148*a* is constructed, to maintain the angle of rudder 178 in the position shown for it in FIG. 4 throughout a relatively wide range of throttle adjustments. The central portion of the opening forming cam 148*a***, therefore, is shaped to allow throttle adjustment throughout a large central portion of the overall range of throttle adjustment without there occurring any appreciable change in rudder angle.

Still another important feature of the invention is the incorporation of locking mechanism 120. While this feature may not be particularly significant to a skilled operator of a powered tethered aircraft, it is important when the apparatus is used by a novice. Generally speaking, it has been found best for a novice to hold the speed of a flying aircraft relatively low, initially, and to practice manuevering of the aircraft simply through elevator control. Locking mechanism 120 allows fixed-position locking of the angular position of wheel 112, and hence fixing of the condition of a controlled throttle.

Those who are skilled in the art, upon the basis of the foregoing description, will appreciate that there are many ways, other than through the use of a rotatable wheel, like wheel 112, in which the links in the linkage arrangement contained in a hand-control device may be driven. An embodiment of the invention employing a rotatable thumb-drivable wheel has been shown inasmuch as it offers one of the most convenient ways to afford throttle control. However, and with only slight modification in the mounting frame provided in a hand-control device, other types of drive mechanisms, such as a thumb-operable pivoted lever, suitably drivingly connected through the linkage arrangement, may be used. Another way would be to use a spring-biased, thumb-operable push button, biased, for example, toward a full-throttle condition. These various other ways, which may easily be used, in no way affect the basic design and function of the linkage mechanisms of the invention. Further, with respect to any such alternate drive arrangement, a locking mechanism, functioning like locking mechanism 120, is readily employable to facilitate operation by a novice, as described earlier.

There is, thus, provided by the present invention a unique three-wire control system for an engine-powered model aircraft, which system, through the incorporation therein of special linkage arrangements, accommodates extremely smooth high-precision control for such an aircraft. Through providing a construction wherein the three tethering lines maintain substantially uniform evenly distributed tension under all control circumstances, and through using special low-friction pivot connections between moving parts (and no sliding connections), this kind of effective control is assured.

In a hand-control device, and as has been pointed out, a variety of specifically different driving arrangements may be used for operating the linkage arrangement employed in such device—the choice of which kind of driving arrangement to use simply being based on considerations of preference and convenience. With regard to any such drive mechanism, selectively operable locking may be provided for which assists, especially, a novice as he learns how to handle such an aircraft.

While a preferred embodiment of the invention has been described, and certain modifications suggested, it is appreciated that other variations and modifications may be made without departing from the spirit of the invention.

It is claimed as desired to secure by Letters Patent:

1. A three-line system for controlling the flight of an engine-powered, tethered model aircraft, with control resulting from changes made in the relative positions of the lines tethering the aircraft, said system comprising a first control-adjustment mechanism including a first frame mountable in such an aircraft and a first plurality of links pivotally connected to said first frame and to each other and providing a set of spaced relatively movable first mounting points having connecting means thereat whereby said first links are adapted for mounting one set of ends of tethering lines used in conjunction with said system, relative movement of said first mounting points occurring solely through nonsliding, nontranslating pivoting action of said first plurality of links relative to each other and to said first frame under the influence of such lines, and a second control-adjustment mechanism including a second frame constructed for hand-holding by an operator, and a second plurality of links pivotally connected to said second frame and to each other and providing a set of spaced relatively movable second mounting points also having connecting means thereat whereby said second links are adapted for mounting the opposite set of ends of such tethering lines, relative movement of said second mounting points occurring solely through nonsliding, nontranslating pivoting action of said second plurality of links relative to each other and to said second frame.

2. The system of claim 1, wherein, with respect to said set of second mounting points, the set includes a pair of spaced lateral points arranged, under all circumstances, equidistant from a center point, and said second plurality of links and pivotal connections therefor in said second control-adjustment mechanism are so constructed that relative movement of said mounting points produces, under all circumstances with said central point moving, substantially straight-line movement of said central point.

3. The system of claim 1, wherein each of said first and second plurality of links includes first and second elongated stabilizer links, and an elongated floating link, with said first stabilizer link being pivoted adjacent one end to the associated frame and being pivoted adjacent its opposite end to said floating link at a point intermediate the latter's opposite ends, and with said second stabilizer link being pivoted adjacent one of its ends to the associated frame and being pivoted adjacent its opposite end to another point on said floating link which is also intermediate the opposite ends of the latter, the pivot axes provided between said associated frame and links being substantially parallel to one another.

4. The system of claim 3, wherein, with regard to the plurality of links associated with said second control-adjustment mechanism, one end of said floating link defines said central mounting point and the opposite end defines one of the lateral mounting points, the point of pivotal connection between said first stabilizer link and said floating link is toward the latter's said one end from the point of pivotal connection between the floating link and said second stabilizer link, and the distances between the point of pivotal connection between said first stabilizer link and said floating link and each of (a) said central mounting point, (b) said point of connection between the floating link and said second stabilizer link, and (c) the point of pivotal connection provided for said first stabilizer link's said one end and the associated frame, are substantially equal.

5. The system of claim 4, wherein, with regard to the plurality of links associated with said second control adjustment mechanism, the distance between said lateral mounting point and the point of pivotal connection between said floating link and said second stabilizer link is substantially the same as said previously mentioned substantially equal distances.

6. The system of claim 4, wherein the distance between the two pivot connections provided for said second stabilizer link is no less than 62.5% of twice each of said substantially equal distances.

7. In a three-line tethered-aircraft control system, a hand-holdable linkage arrangement for accommodating attachment of ends of control lines, and further for accommodating relative movement of such lines to effect control of an aircraft, said linkage arrangement comprising a hand-holdable frame, first and second elongated stabilizer links, an elongated floating link, including means adjacent its ends for accommodating the attachment of such control line ends, first pivot means pivoting said first stabilizer link adjacent one of its ends to said frame, and second pivot means pivoting said first stabilizer link adjacent its opposite end to said floating link at a point intermediate the latter's opposite ends, and third pivot means pivoting said second stabilizer link adjacent one of its ends to said frame, and fourth pivot means pivoting said second stabilizer link adjacent its opposite end to another point on said floating link also intermediate the latter's opposite ends, the pivot axes provided by said pivot means being substantially parallel.

8. The linkage arrangement of claim 7, wherein one end of said floating link defines one mounting point for a line, and the opposite end defines another mounting point for a line, said second pivot means provides a pivot axis located toward said one end of said floating link from the pivot axis provided by said fourth pivot means, and the distances between said second pivot means' pivot axis and each of (a) said one mounting point, (b) said fourth pivot means' pivot axis, and (c) said first pivot means' pivot axis, are substantially equal.

9. The linkage arrangement of claim 8 wherein the distance between said other mounting point and said fourth pivot means' pivot axis is substantially the same as said previously mentioned substantially equal distances.

10. The system of claim 8, wherein the distance between said third and fourth pivot means is no less than 62.5% of twice each of said substantially equal distances.

11. The system of claim 10, wherein said fourth pivot means travels between a pair of spaced limit points with operation of said linkage arrangement, and said third pivot means is positioned on a line which is disposed at a right angle to a line interconnecting said limit points, said first-mentioned line extending substantially centrally between said limit points.

* * * * *